US005241748A

United States Patent [19]

Ishida

[11] Patent Number: 5,241,748

[45] Date of Patent: Sep. 7, 1993

[54] METHOD FOR MANUFACTURING A COMPRESSION RING

[75] Inventor: Masao Ishida, Okaya, Japan

[73] Assignee: Teikoku Piston Ring Co., Ltd., Tokyo, Japan

[21] Appl. No.: 902,027

[22] Filed: Jun. 22, 1992

[30] Foreign Application Priority Data

Jun. 27, 1991 [JP] Japan ..... 3-183025
Aug. 14, 1991 [JP] Japan ..... 3-228818

[51] Int. Cl.[5] ..... B21H 1/06

[52] U.S. Cl. ..... 29/888.074; 29/888.076

[58] Field of Search ..... 29/888.07, 888.074, 29/888.076; 148/228, 230, 238; 277/235 A; 427/39

[56] References Cited

U.S. PATENT DOCUMENTS

| | | | |
|---|---|---|---|
| 3,806,139 | 4/1974 | Suzuki et al. | 277/235 A |
| 4,085,490 | 4/1978 | McCormick et al. | 29/888.073 |
| 4,570,946 | 2/1986 | Tsuchiya et al. | 277/235 A |
| 5,104,132 | 4/1992 | Onoda et al. | 277/235 A |

FOREIGN PATENT DOCUMENTS

| | | | |
|---|---|---|---|
| 0118772 | 9/1984 | European Pat. Off. . | |
| 2-129467 | 5/1990 | Japan | 277/235 A |
| 512134 | 8/1939 | United Kingdom . | |
| 512594 | 9/1939 | United Kingdom . | |
| 2125931 | 6/1983 | United Kingdom . | |
| 2131121 | 6/1984 | United Kingdom . | |
| 2153488 | 1/1985 | United Kingdom . | |
| 2153965 | 1/1985 | United Kingdom . | |

*Primary Examiner*—Timothy V. Eley
*Assistant Examiner*—Kenneth J. Hansen
*Attorney, Agent, or Firm*—Armstrong, Westerman, Hattori, McLeland & Naughton

[57] ABSTRACT

A compression ring provided with both ends having notches is formed on outer peripheral surface with a plasma nitrided layer and is formed on upper and lower surfaces and an inner peripheral surface with soft surface treatment layers. The upper and lower surfaces and the inner peripheral surface may be of base material surfaces.

10 Claims, 5 Drawing Sheets

METHOD FOR MANUFACTURING A COMPRESSION RING

BACKGROUND OF THE INVENTION

1. Field of the Invention

The present invention relates to a compression ring used for internal combustion engines and compressors, and a method for manufacturing the same.

2. Description of the Related Art

Recently, nitriding has been applied to a compression ring. Nitriding is carried out by gas nitriding or salt-bath nitriding. According to these methods, not only an outer peripheral surface but also upper and lower surfaces and an inner peripheral surface become nitrided.

As described above, the whole peripheral portion of the ring becomes nitrided. Therefore, when a thick nitriding is applied to a ring which is thin in width and provided with both ends having notches, a notched portion having a small sectional area in each end increases against brittleness, decreases against strength, and possibly breaks from that portion. Because of this, it is not possible to meet the demands of implementation of thin-width and high wear resistance of the ring.

SUMMARY OF THE INVENTION

It is an object of the present invention to meet, in a compression ring provided with both ends having notches, the demands of implementation of thin-width and high wear resistance of the ring while retaining strength against breakage.

The compression ring provided with both ends having notches according to the present invention comprises a nitrided layer formed on only the outer peripheral surface of said ring, said nitrided layer is a plasma nitrided layer. The upper and lower surfaces and an inner peripheral surface of the ring are base surfaces or are formed with soft surface treatment layers.

A method of manufacturing a compression ring according to the present invention comprises the steps of coiling a ring material, cutting the coiled material to obtain a plurality of rings, machining both ends of said ring, applying plasma nitriding to said coiled material or said ring to form a nitrided layer on only an outer peripheral surface. In the case where upper and lower surfaces or an inner peripheral surface or upper and lower surfaces and an inner peripheral surface are formed with soft surface treatment layers, the soft surface treatment is applied prior to the step of finishing the workpiece.

The aforementioned soft surface treatment is a surface treatment selected from a group of phosphate coating treatment, ferrox coating treatment, sulfide coating treatment, tin plating, soft alloy plating, copper plating, and resin fluoride coating treatment, or a composite coating treatment composed of at least two surface treatments selected from said group.

Since the compression ring is provided in only its outer peripheral surface with a plasma nitrided layer, the abrasion resistance with respect to the sliding contact with the cylinder is good. Since the upper and lower surfaces and an inner peripheral surface are base surfaces or are formed with soft surface treatment layers, the abnormal abrasion of the ring groove of a piston is hard to occur. When a soft surface treatment layer is formed, the good anticorrosion is obtained.

By the selection of the plasma nitriding as a nitriding having a directivity of treatment without the application of a particular anti-nitriding treatment or of the work removing a nitrided layer, nitriding can be easily applied to only the outer peripheral surface without the upper and lower surfaces and an inner peripheral surface of the compression ring being nitrided. Since the nitriding can be applied to only the outer peripheral surface, in the case that a thick nitriding is applied to a ring which is thin in width and provided with both ends having notches, the ring can retain strength against breakage of a notched portion having a small sectional area in each end. Accordingly, there can be obtained a ring which is thin in width, which has a strength of breakage and which is excellent in wear resistance. Great effect can be obtained particularly in the ring which has a ring width of less than 1.2 mm and a thickness of a nitrided layer of 70 μm or more.

BRIEF DESCRIPTION OF THE DRAWINGS

The above and other objects and other features of the present invention will become more apparent in reference to the following detailed description and the accompanying drawings.

DESCRIPTION OF THE PREFERRED EMBODIMENTS

Figure 1:
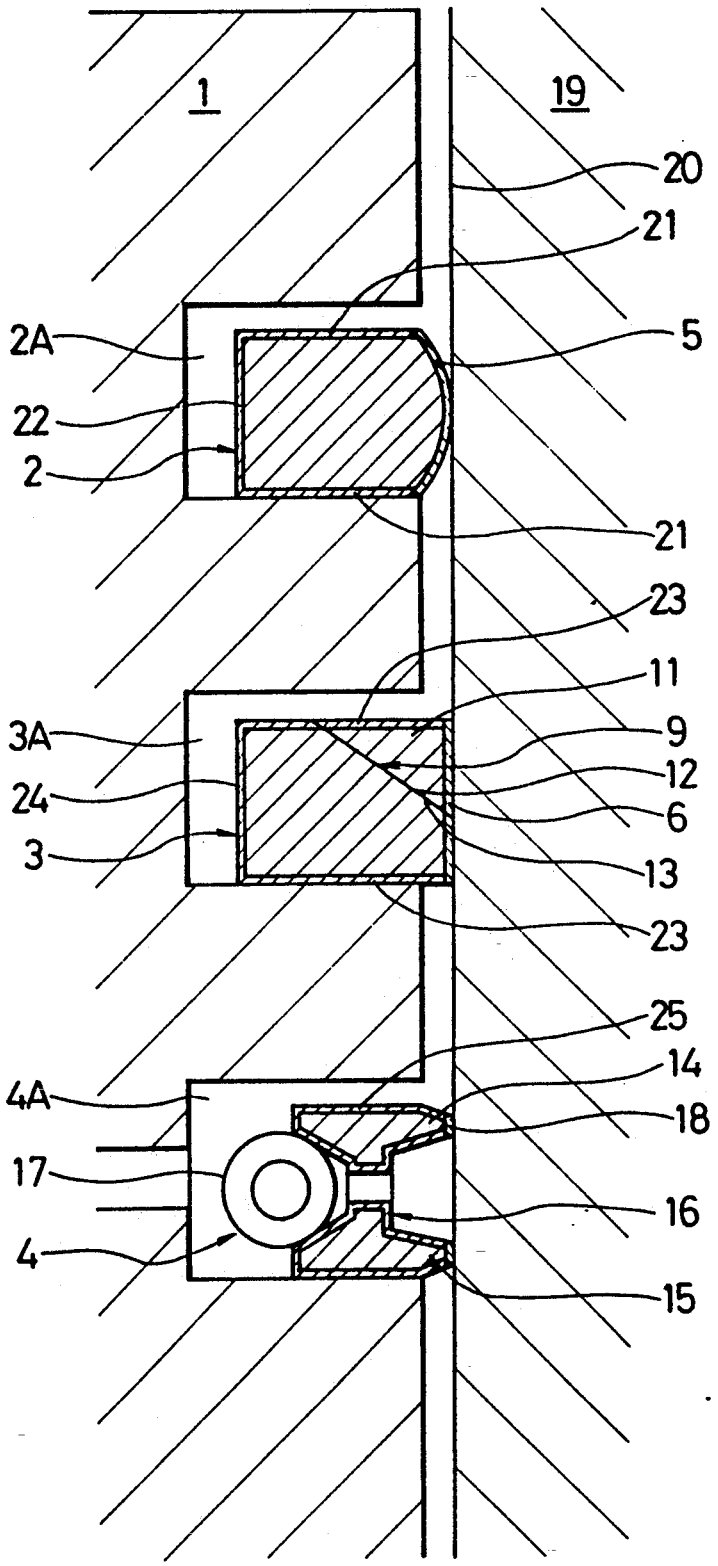
FIG. 1 is a longitudinal sectional view showing a part of a piston which is inserted into a cylinder and has three rings including a compression ring according to the present invention.

In FIG. 1, a piston 1 made of aluminium alloy is formed in its outer peripheral surface with two compression ring grooves 2A and 3A and one oil ring groove 4A. A top ring 2 is fitted in the uppermost compression ring groove 2A, a second ring 3 is fitted in the compression ring groove 3A under the groove 2A, and a combined oil ring 4 is fitted in the oil ring groove 4A under the groove 3A.

The top ring 2 has its outer peripheral surface formed into a barrel shape, has straight cut ends, and is provided with a plasma nitrided layer 5 on only the outer peripheral surface of the ring which is pressed into contact with an inner wall surface 20 of a cylinder 19. Upper and lower surfaces and an inner peripheral surface of the ring are formed with soft surface treatment layers 21 and 22.

The second ring 3 has both ends having notches, and is provided with a plasma nitrided layer 6 on only the outer peripheral surface of the ring which is pressed into contact with the inner wall surface 20 of the cylinder 19. Upper and lower surfaces and an inner peripheral surface of the ring are formed with soft surface treatment layers 23 and 24. The ring 3 has a rectangular section.

Figure 2:
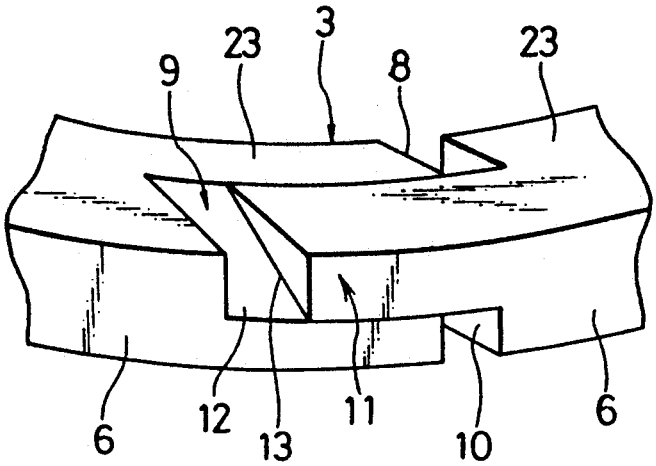
FIG. 2 is a perspective view showing end portions of a second ring according to the present invention.
Figure 3:
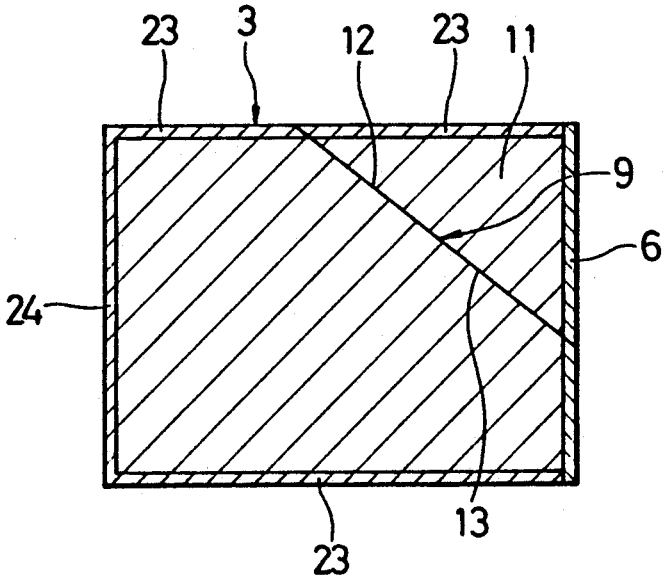
FIG. 3 is a longitudinal sectional view of end portions of a second ring according to the present invention.

Both ends construction of the second ring 3 is such that as shown in FIGS. 1 to 3, an upper surface of one end is formed with a notch 9 which opens to an outer peripheral surface of the ring and an end surface 8, and the other end is also formed with a notch so that a projecting portion 11 to be arranged at a portion of the notch 9 is provided in the other end. The notch 9 and the projecting portion 11 have the same triangular shapes in longitudinal-section taken in a radial direction. An inclined surface 13 of the projecting portion 11 in the other end is overlapped on an inclined surface 12 of the notched portion in one end. The ring 3 is fitted in the ring groove 3A, leaving a predetermined clearance between both end surfaces 8 and 10. While in the above illustration, the sectional shapes of the notch 9 and the projecting portion 11 are triangular shapes, it is to be noted that the shape is not limited thereto but other shapes such as a rectangular shape may also be employed.

The combined oil ring 4 is a two-piece combined oil ring made of steel, which comprises an oil ring 16 having a section of substantially I-shape provided with upper and lower rails 14 and 15, and a coil expander 17 fitted in an inner peripheral groove of the oil ring 16. The rails 14 and 15 are provided in their outer peripheral surfaces with hard chrome platings 18, and are pressed into contact with the inner wall surface 20 of the cylinder 19 by the coil expander 18. Surfaces other than the outer peripheral surface of the oil ring 16 are formed with soft surface treatment layers 25.

One example of a method for manufacturing the second ring 3 will be described below. A coiled material is prepared from a (martensitic) stainless steel wire. This coiled material is cut into a plurality of rings, and then both ends of each ring are machined to have notches. Then, these rings are inserted around the outer peripheral surface of a cylindrical member of a jig to have a stacked configuration. Clamp disks of the jig are disposed on opposite ends of the stacked rings. A nut is threadedly engaged with a tapped portion of a shaft portion which extends from one clamp disk and extends through a center hole of the other clamp disk, and the nut is axially tightened and fixed. Then, the nitriding is applied to the outer peripheral surface in a plasma nitriding oven. The conditions of the plasma nitriding are, for example, as follows:

Composition of atmospheric gases:

Nitrogen:hydrogen = 7:3

Work temperature:500° C.

A plasma nitrided layer having a depth of 70 μm with a Vickers hardness of Hv 700 or more is obtained in an outer peripheral surface.

It is to be noted that the plasma nitriding of the outer peripheral surface can be done in the stage of the coiled material.

Since discharge occurs in only the outer peripheral surface of a workpiece in nitriding, the outer peripheral surface of the compression ring is nitrided. However, since the upper and lower surfaces have no clearance therebetween because they are in contact with each other and the inner peripheral surface is in contact with the cylindrical surface of the jig, no discharge occurs in these surfaces. Accordingly, it is possible to obtain a compression ring in which upper and lower surfaces and an inner peripheral surface are free from a nitrided layer.

After the plasma nitriding, a plurality of rings are removed from the jig, and the soft surface treatment is applied to the upper and lower surfaces and the inner peripheral surface by a conventional manner to form soft surface treatment layers on the upper and lower surfaces and the inner peripheral surface. The soft surface treatment is a surface treatment selected from a group of phosphate coating treatment, ferrox coating treatment, sulfide coating treatment, tin plating, soft alloy plating, copper plating, and resin fluoride coating treatment, or a composite coating treatment composed of at least two surface treatments selected from said group.

Thereafter, the compression ring is finished in a conventional method.

Figure 4:
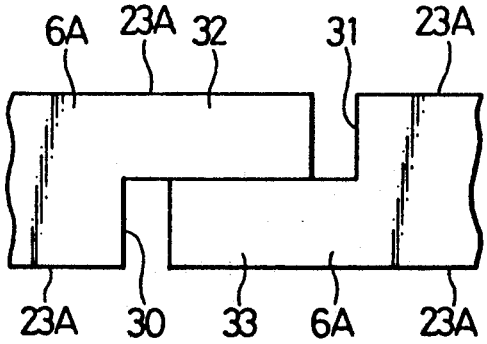
FIG. 4 is a front view showing end portions of another compression ring according to the present invention.
Figure 5:
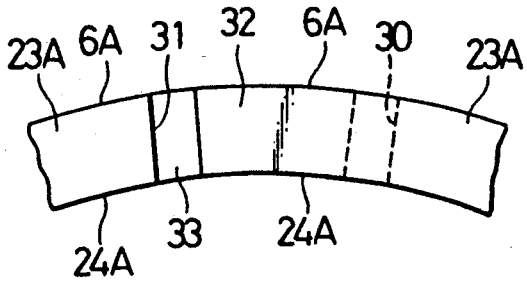
FIG. 5 is a plan view of FIG. 4.

Of course, the construction of the ends to which the present invention is applied, is not limited to that shown above but other constructions, for example, as shown in FIGS. 4, 5, 6, 7 and 8 may be employed. In FIGS. 4 and 5, step joint construction is shown, in which a notch 30 is provided at a lower portion of one end, and a notch 31 is provided at an upper portion of the other end, these both ends respectively forming steps so that projecting portions 32 and 33 of the respective ends are overlapped. A plasma nitrided layer 6A is formed on only the outer peripheral surface, and the upper and lower surfaces and the inner peripheral surface of the ring are formed with soft surface treatment layers 23A and 24A.

Figure 6:
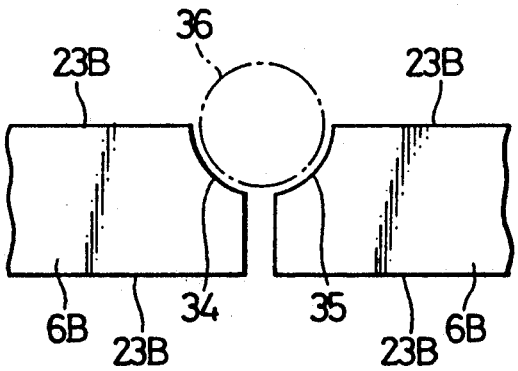
FIG. 6 is a front view showing end portions of another compression ring according to the present invention.
Figure 7:
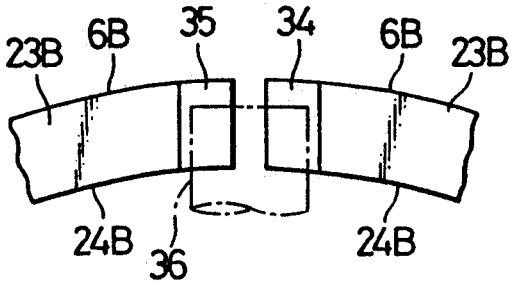
FIG. 7 is a plan view of FIG. 6.
Figure 8:
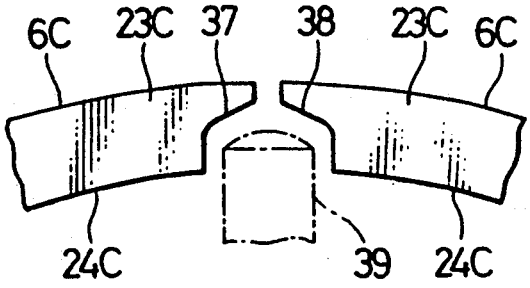
FIG. 8 is a plan view showing end portions of another compression ring according to the present invention.

In FIGS. 6, 7 and 8, a construction of ends for preventing a rotation of a ring is shown. FIGS. 6 and 7 show one example. Notches 34 and 35 are provided respectively at upper portions of both ends. A pin 36 which is projected in a ring groove of a piston is arranged in the notches 34 and 35. A plasma nitrided layer 6B is formed on only the outer peripheral surface of the ring, and the upper and lower surfaces and the inner peripheral surface of the ring are formed with soft surface treatment layers 23B and 24B. FIG. 8 shows another example. Notches 37 and 38 are provided respectively at inner peripheral portions of both ends. A pin 39 which is projected in a ring groove of a piston is arranged in the notches 37 and 38. A plasma nitrided layer 6C is formed on only the outer peripheral surface of the ring, and the upper and lower surfaces and the inner peripheral surface of the ring are formed with soft surface treatment layers 23C and 24C.

While in the above-described embodiment, the upper and lower surfaces and the inner peripheral surface have been formed with the soft surface treatment layers, it is to be noted that the upper and lower surfaces and the inner peripheral surface may be of base material surfaces.

Figure 9:
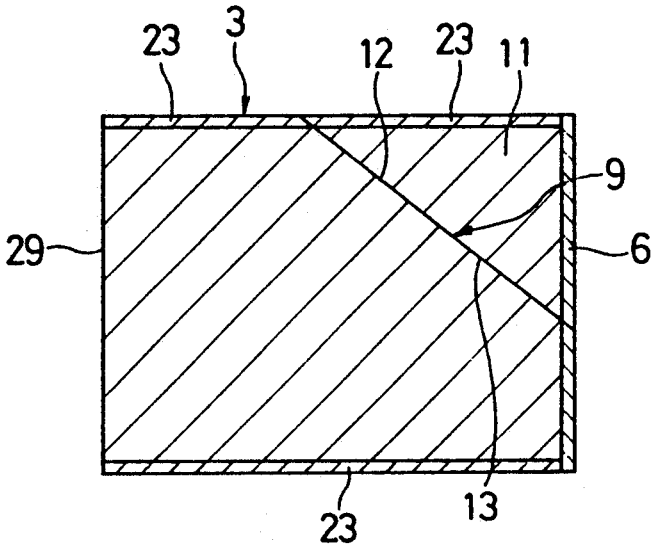
FIG. 9 is a longitudinal sectional view showing end portions of another second ring according to the present invention.

FIG. 9 is a longitudinal sectional view of end portions of a second ring having the same construction as that of the second ring 3 shown in FIGS. 1 to 3. This second ring 3 is formed on only the outer peripheral surface thereof with a plasma nitrided layer 6, and is formed on only the upper and lower surfaces with soft surface treatment layers 23. The inner peripheral surface is a base material surface 29.

Figure 10:
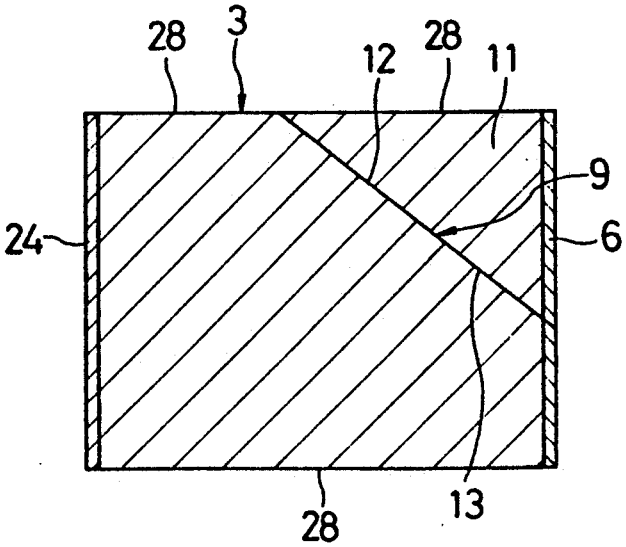
FIG. 10 is a longitudinal sectional view showing end portions of another second ring according to the present invention.

FIG. 10 is a longitudinal sectional view of end portions of a second ring having the same construction as the second ring 3 shown in FIGS. 1 to 3. This second ring 3 is formed on only the outer peripheral surface thereof with a plasma nitrided layer 6, and is formed on the inner peripheral surface with a soft surface treatment layer 24. The upper and lower surfaces are base material surfaces 28.

Figure 11:
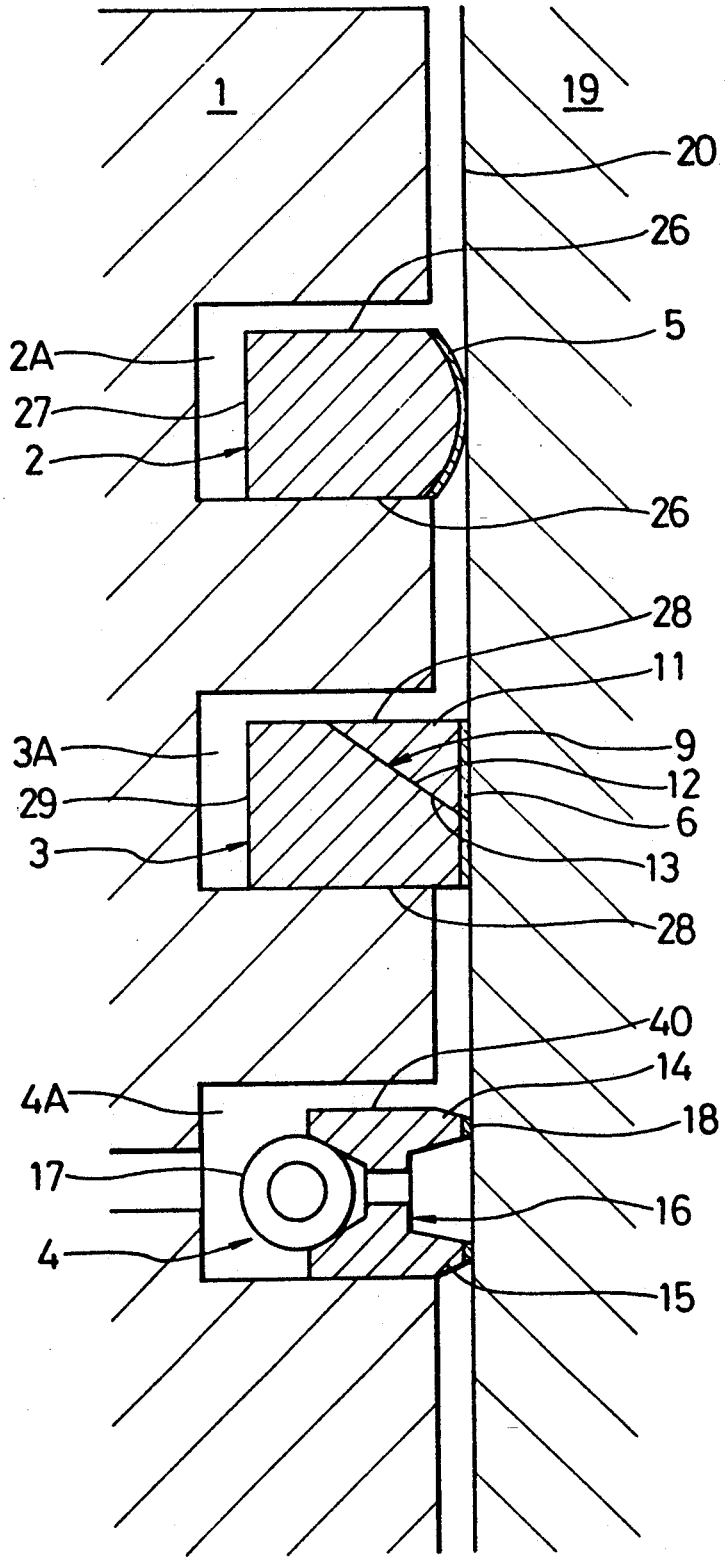
FIG. 11 is a longitudinal sectional view corresponding to FIG. 1 showing a piston having another second ring according to the present invention.

FIG. 11 is a view, corresponding to FIG. 1, of a piston provided with a second ring having the same construction as the second ring 3 shown in FIGS. 1 to 3. This second ring 3 is formed on only the outer peripheral surface with a plasma nitrided layer 6, and the upper and lower surfaces and the inner peripheral surface of the ring are base material surfaces 28 and 29. A top ring 2 and a combined oil ring 4 shown in FIG. 11 are of the same construction as those shown in FIG. 1. However, the upper and lower surfaces and the inner peripheral surface of the top ring 2 are base material surfaces 26 and 27, and the surfaces other than the o peripheral surface of the oil ring 16 are base material surfaces 40.

While in the foregoing, an example has been illustrated in which the construction of both ends having notches is applied to the second ring 3, it is to be noted that needless to say, the aforesaid ends construction can be applied to other compression rings, such as a top ring. In this case, a plasma nitrided layer is formed on only the outer peripheral surface of the ring. The upper and lower surfaces and an inner peripheral surface of the ring are base material surfaces or are formed with soft surface treatment layers.

Although the present invention has been described with reference to preferred embodiments, it is apparent that the present invention is not limited to the aforesaid preferred embodiments, but various modification can be attained without departing from its scope.

What is claimed is:

1. A method for manufacturing compression rings each provided with circumferential ends having notches, comprising:

coiling a ring material;

cutting said coiled material to obtain a plurality of rings, each ring having two circumferential ends, upper and lower axially peripheral surfaces, and inner and outer radially peripheral surfaces;

machining both circumferential ends of each ring to form said notches, assembling said plurality of rings on a jig where said axially peripheral surfaces of adjacent rings are in contact;

applying plasma nitriding to said assembled rings having said adjacent axially peripheral surfaces in contact such that a nitrided layer is formed on only said outer radially peripheral surfaces of said plurality of rings.

2. A method for manufacturing a compression ring as claimed in claim 1 comprising applying a soft surface treatment to form soft surface treatment layers on said upper and lower axially peripheral surfaces of each ring.

3. A method for manufacturing a compression ring as claimed in claim 1 comprising applying a soft surface treatment to form a soft surface treatment layer on said inner radially peripheral surface of each ring.

4. A method for manufacturing a compression ring as claimed in claim 1, comprising applying a soft surface treatment to form soft surface treatment layers on said upper and lower axially peripheral surfaces and said inner radially peripheral surface of each ring.

5. A method for manufacturing a compression ring as claimed in claim 1, wherein the inner radially peripheral surfaces of the plurality of rings are in contact with an outer cylindrical surface of the jig during nitriding.

6. A method for manufacturing a compression ring as claimed in claim 5, wherein said assembled rings are axially clamped together prior to nitriding.

7. A method for manufacturing a compression ring as claimed in claim 6, wherein said ring material comprises a martensitic stainless steel.

8. A method for manufacturing a compression ring as claimed in claim 1, wherein said nitriding step is performed in a plasma nitriding oven in an atmosphere of nitrogen and hydrogen.

9. A method for manufacturing a compression ring as claimed in claim 8, wherein the ratio of nitrogen to hydrogen is approximately 7:3 and the nitriding temperature in said nitriding oven is approximately 500 C.

10. A method for manufacturing a compression ring as claimed in claim 9, wherein the nitrided layer formed in the nitriding step has a depth of approximately 70 μm and a Vickers hardness of at least Hv 700.

* * * * *